United States Patent [19]

Tillmann et al.

[11] Patent Number: 4,785,493

[45] **Date of Patent: * Nov. 22, 1988**

[54] DOOR CHECK

[75] Inventors: Horst Tillmann, Ennepetal; Giselher Sieg, Ratingen, both of Fed. Rep. of Germany

[73] Assignee: Dorma-Baubeschlag GmbH & Co. KG, Ennepetal, Fed. Rep. of Germany

[ * ] Notice: The portion of the term of this patent subsequent to Apr. 21, 2004 has been disclaimed.

[21] Appl. No.: 5,749

[22] Filed: Jan. 21, 1987

Related U.S. Application Data

[63] Continuation-in-part of Ser. No. 678,243, Dec. 5, 1984, Pat. No. 4,658,468.

[30] Foreign Application Priority Data

Dec. 13, 1983 [DE] Fed. Rep. of Germany ..... 3345004

[51] Int. Cl.[4] ..... E05F 3/10; E05F 1/14; E05F 5/02

[52] U.S. Cl. ..... 16/53; 16/56; 16/58; 16/76; 16/82; 16/DIG. 10; 16/DIG. 17

[58] Field of Search ..... 16/51, 52, 53, 54, 55, 16/56, 58, 59, 60, 66, 72, 71, 76, 82, DIG. 10, DIG. 17

[56] References Cited

U.S. PATENT DOCUMENTS 4,658,468 4/1987 Tilmann et al. ..... 16/58

FOREIGN PATENT DOCUMENTS 1168983 10/1969 United Kingdom ..... 16/53

*Primary Examiner*—Nicholas P. Godici
*Assistant Examiner*—Edward A. Brown
*Attorney, Agent, or Firm*—Peter K. Kontler

[57] ABSTRACT

A door check wherein a housing is affixed to the pivotable panel and a guide rail is affixed to the frame of a door. The housing contains a shaft which is rigidly connected with one end of an arm the other end of which is slidably guided by the rail. The shaft carries a disc cam having two asymmetric sections one of which is tracked by a spring-biased follower surrounding an antifriction bearing and tending to return the panel to its closed position and the other of which is tracked by a roller on the piston of a damper which yieldably opposes the movement of the panel back to its closed position. The configuration of the two cam sections is selected with a view to allow for a reduction of the resistance which the follower offers to opening of the door shortly after the panel leaves its closed position as well as to ensure that the damper can operate independently of the follower and vice versa. The damper has a spring which urges the roller against the cam and whose bias is not more than 50 percent of the bias of one or more springs which urge the follower against the cam.

19 Claims, 2 Drawing Sheets

DOOR CHECK

CROSS-REFERENCE TO RELATED CASE

This is a continuation-in-part of the commonly owned copending patent application Ser. No. 678,243 filed Dec. 5, 1984 for "Door check", now U.S. Pat. No. 4,658,468 granted Apr. 21, 1987.

BACKGROUND OF THE INVENTION

The present invention relates to door closers or door checks in general, and more particularly to improvements in door checks of the type wherein a shaft is caused to rotate in response to pivoting of a door panel to an open or closed position under the action of an arm one end portion of which is non-rotatably affixed to the shaft and the other end portion of which is slidable along a guide mounted on the door frame if the shaft is mounted on the panel or vice versa.

In door checks of the above outlined character, the panel is pivoted to an open position against the opposition of resilient means serving to return the panel to the closed position as soon as a person, a vehicle or a holding device ceases to apply a force which causes the panel to move toward its fully open position or to dwell in the open or partly open position. Moreover, such door checks comprise suitable dampers which ensure a more or less gradual closing of the panel, i.e., the damper prevents the panel from slamming against the frame of a door under the action of the resilient means. The just described door checks are preferred under circumstances when the appearance is important and/or when the available space does not allow for the installation of other types of door checks, especially those wherein the shaft is rotated by a linkage normally including a first link which is non-rotatably connected to the shaft and a second link which is articulately connected to the first link and to a fixed pivot member on the panel or on the door frame. However, the presently known door checks of the type wherein the shaft is connected with an arm which is slidable along a guide rail or the like exhibit a number of serious drawbacks so that their popularity is rather limited. One of the most serious drawbacks of such door checks is that the closing force is often a small fraction of the closing force of door checks which employ a linkage between the rotatable spring-biased shaft and the door frame or door panel. The difference between the closing forces of the two types of door checks can be as high as 60 percent. An undesirable consequence of the relatively small closing force of door checks with a single arm is that the magnitude of the force which is required to pivot a door panel from its closed position increases during the initial stage of pivoting through an undesirably large angle (up to and even in excess of 60 degrees). This is in contrast with the door checks wherein the shaft is connected to a linkage and the force with which the panel must be pivoted from open position decreases from a maximum value to a much lower value upon completion of an angular movement through a few degrees and thereupon decreases gradually to reach a constant value (which is much smaller than the maximum value) not later than when the panel has been caused to pivot through an angle of approximately 50 degrees.

It has been found that presently known door checks wherein the shaft is connected with a single arm offer a very pronounced resistance to movement of the door panel from its closed position through an excessive angle which causes discomfort to the person attempting to move the panel to its open position, even to a person who is accustomed to encounter a rather pronounced resistance to such movement but only during a small initial stage. This is the reason for the lack of popularity of presently known single-arm type door checks in spite of the fact that their appearance is much more pleasing to the eye than that of the door checks wherein the shaft is connected with several links and none of the links are slidable along a guide rail or the like. As a rule, door checks with a single arm are presently used only on doors wherein the required closing force is small or negligible.

OBJECTS AND SUMMARY OF THE INVENTION

An object of the invention is to provide a novel and improved door check of the type wherein the shaft is connected to and is caused to turn by a single arm which is slidable along a guide on the stationary part or on the pivotable part of a door.

Another object of the invention is to provide a door check of the just outlined character which is of eye-pleasing appearance and whose performance is at least as satisfactory as that of door checks wherein the shaft is rotated by a set of interconnected links.

A further object of the invention is to provide novel and improved means for transmitting torque to the shaft of the above outlined door check.

An additional object of the invention is to provide a door check with a novel and improved damper.

Still another object of the invention is to provide a door check wherein the resistance to opening of a door panel and the force with which the panel is closed can be regulated within a wide range in a simple and efficient way.

A further object of the invention is to provide novel and improved cam means for use in the above outlined door check.

An additional object of the invention is to provide a novel and improved method of regulating the forces which oppose the opening of a door panel and which cause the panel to reassume its closed position.

A further object of the invention is to provide a simple, compact and eye-pleasing door check which can be used as a superior substitute for heretofore known door checks wherein the shaft is connected to a single arm or to one link of a set of articulately connected links.

The invention is embodied in a door check which comprises a housing connectable to a pivotably mounted door panel, a shaft which is rotatably journalled in the housing and can be coupled to the frame for the door panel, cam means (e.g., a heart cam) provided on the shaft in the housing and having a first and a second section, means for transmitting torque to the first section of the cam means so as to urge the cam means to rotate in a predetermined direction (so as to close the door panel), and damper means for yieldably opposing rotation of the shaft in the predetermined direction. The torque transmitting means comprises a first support which is movable in the housing at one side of the cam means and its shaft, a first follower rotatably mounted on the first support and tracking the first section of the cam means, and first resilient means for biasing the support so as to urge the follower against the first section of the cam means with a first force. The damper means comprises a second support which is movable in the housing at the other side of the shaft, a second follower which is provided on the second support and tracks the second section of the cam means, and second resilient means for biasing the second support so as to urge the second follower against the second section of the cam means with a second force which at most equals 50 percent of the first force.

The first support comprises a pivot member (e.g., a stub shaft) for the first follower and a bearing (preferably an antifriction bearing, such as a needle bearing) between the pivot member and the first follower. The second support can also comprise a pivot member for the second follower and a bearing (preferably an antifriction bearing, such as a needle bearing) between the pivot member and the second follower.

At least one of the resilient means can comprise at least one helical spring.

The housing can comprise a first cylinder in which the first support is reciprocable (not unlike a piston or plunger) substantially at right angles to the axis of the shaft, and a second cylinder which is preferably coaxial with the first cylinder and in which the second support is reciprocable substantially at right angles to the axis of the shaft.

The housing is preferably elongated and the shaft preferably extends transversely of the housing and is remote from both ends of the housing.

Means can be provided for adjusting the bias of the second and/or first resilient means.

The followers are preferably rotatable about axes which are at least substantially parallel to the axis of the shaft.

At least one end portion of the shaft extends from the housing. The arrangement is preferably such that both end portions of the shaft extend from the housing because this renders it possible to use the improved door check on right-hand or left-hand doors. At least one of the projecting end portions is preferably non-circular.

The cam means can include a disc cam, particularly a specially designed heart cam wherein the first section is asymmetrical to the second section.

The novel features which are considered as characteristic of the invention are set forth in particular in the appended claims. The improved door check itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
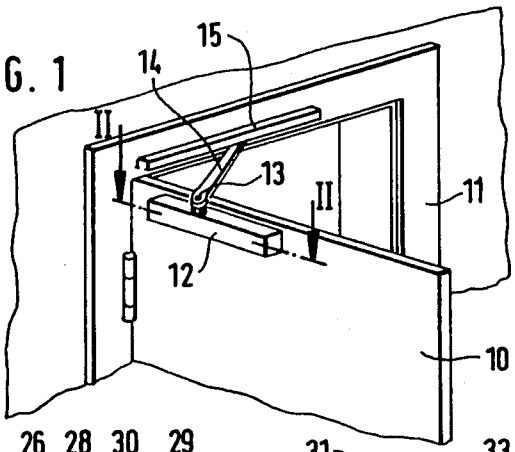
FIG. 1 is a fragmentary perspective view of a door with the panel shown in partly open position and further showing a door check with embodies one form of the invention.

FIG. 1 shows the upper portion of a door including a frame 11 and a panel 10 which is pivotable with reference to the frame 11 between open and closed positions about the common axis of several vertical hinges of which only one can be seen in the drawing. The panel 10 is shown in a partly open position; as a rule, this panel is pivotable through an angle of approximately 180 degrees between a closed and a fully open position.

The improved door check comprises two components one of which includes an elongated guide 15 in the form of a hollow rail having an elongated slot and being installed on the upper horizontal member of the frame 11 close to the pivot axis for the panel 10. The other component of the improved door check comprises a substantially horizontal arm 14 one end portion of which extends through the slot and into the interior of the hollow rail 15 where it carries a roller or another suitable follower arranged to roll or slide back and forth in response to pivoting of the panel 10 between its closed and open positions. The follower on that end portion of the arm 14 which extends into the rail 15 is remote from the pivot axis of the panel 10 when the latter is held in the closed position, and such follower advances toward the pivot axis in response to movement of the panel 10 toward its fully open position. The second component of the improved door check further comprises an elongated box-shaped unit 12 which is mounted on the upper portion of the panel 10 and includes a vertical shaft 13 whose upper end portion constitutes a stub 17 (see FIG. 3) which is non-rotatably connected to the other end portion of the arm 14. Thus, the shaft 13 is compelled to rotate in an elongated housing or case 16 of the unit 12 when the panel 10 is caused to pivot with reference to the frame 11 of the door.

Figure 3:
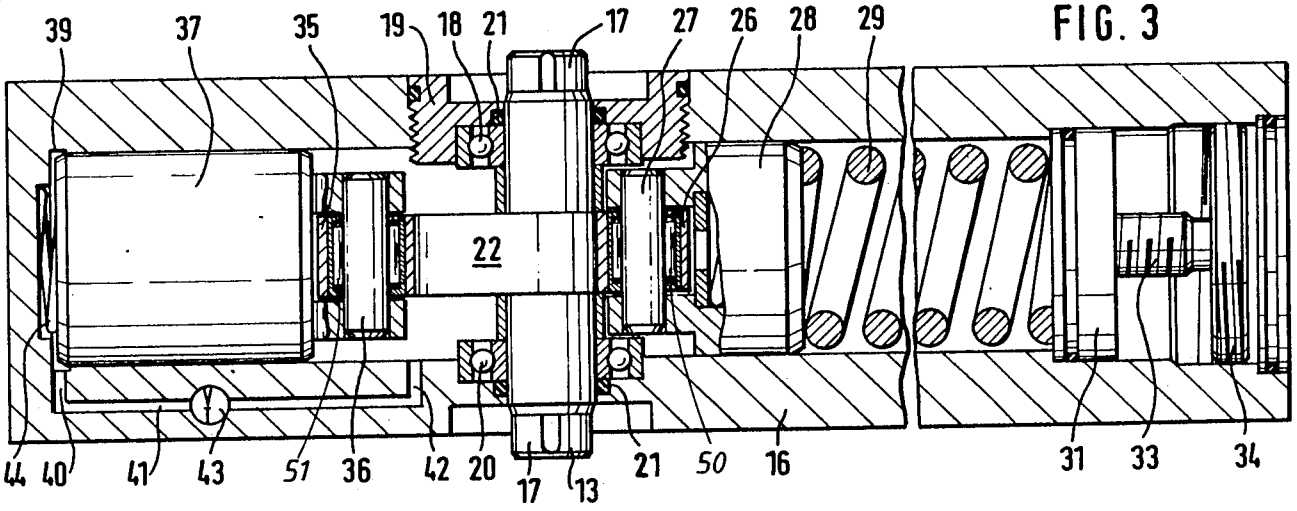
FIG. 3 is a vertical sectional view as seen in the direction of arrows from the line III—III of FIG. 2.

The housing 16 contains a supply of a liquid medium, preferably oil, and the shaft 13 is mounted substantially or exactly midway between the longitudinal ends of the housing. As can be seen in FIG. 3, the top wall of the housing 16 has a tapped bore for an externally threaded annular holder 19 which surrounds an antifriction bearing 18 for the adjacent portion of the shaft 13. The stub 17 at the upper end of the shaft 13 has a polygonal or other suitable outline to facilitate the establishment of a rotation-preventing connection with the corresponding end portion of the arm 14. The lower end portion of the shaft 13 constitutes a second stub 17 which also extends from the housing 16 and can be used for attachment to the respective end portion of an arm 14 if the housing 16 is to be attached to a door in a position turned through 180 degrees with the position shown in FIG. 1 or if the door check employs two arms. The lower wall of the housing 16 has a recess for a portion of a second antifriction bearing 20 which surrounds the lower portion of the shaft 13 in the housing. Suitable seals (e.g., O-rings), of which only two are specifically identified in FIG. 3 by reference characters 21, are provided in the housing 16 in the regions of the end portions of the shaft 13 to prevent escape of the confined liquid medium.

Figure 2:
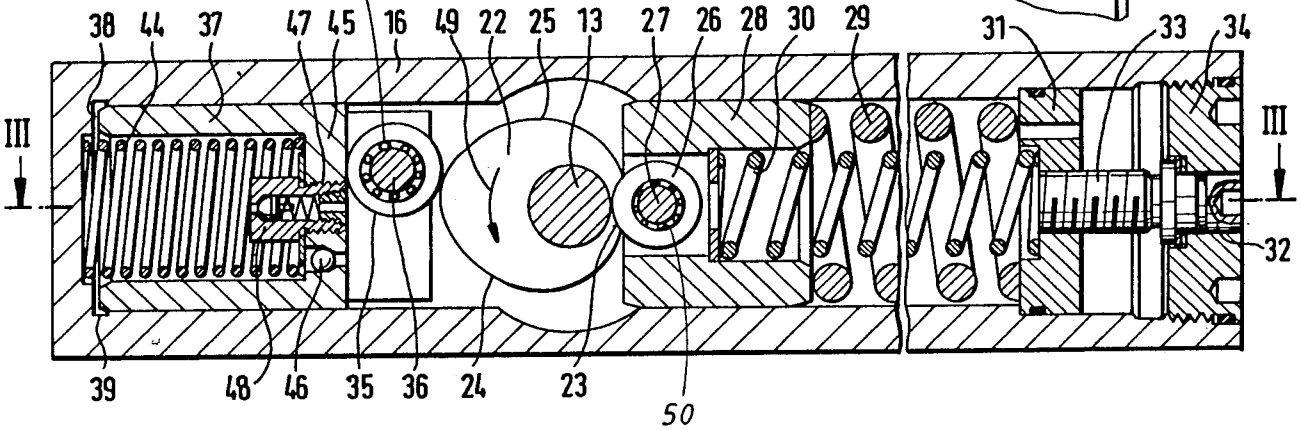
FIG. 2 is a greatly enlarged horizontal sectional view of the major part of one component of the door check substantially as seen in the direction of line II—II of FIG. 1.

The median portion of the shaft 13 is connected or made integral with a disc-shaped cam 22 which, as shown in FIG. 2, can constitute or resemble a heart cam. The circumferentially extending face of the cam 22 comprises a first section 23, 24 which is tracked by a first rotary element in the form of a roller 26 mounted on a vertical pivot member 27 parallel to the shaft 13, and a second section 25 which is tracked by a rotary follower element in the form of a roller 35 mounted on a pivot member 36 which is also parallel to the shaft 13. The portion 23 of the section 23, 24 has a concave shape and defines a seat or socket for a portion of the roller 26 when the cam 22 and its shaft 13 assumes the angular positions of FIG. 2 in which the panel 10 is assumed to be held in the closed position. The portion 24 of the first section 23, 24 of the face on the cam 22 is tracked by the roller 26 as soon as the panel 10 is pivoted from its closed position, and the section 25 is tracked by the roller 35 whenever the panel 10 is caused to leave its closed position. In FIG. 2, the roller 35 contacts the tip of a lobe on the cam 22 substantially but not exactly diametrically opposite the socket 23. The sections 23, 24 and 25 are asymmetrical to each other with reference to a plane which includes the axis of the shaft 13, i.e., the throw of the section 23, 24 for the roller 26 is different from the throw of the section 25 for the roller 35.

The roller 26 is mounted on an antifriction bearing 50 (preferably a needle bearing), and the roller 35 is preferably (but not necessarily) mounted on an antifriction bearing 51 (preferably a needle bearing).

The roller 26 and its pivot member 27 constitute two elements of a follower which is mounted on a reciprocable support or plunger 28. The follower and the plunger form part of a torque transmitting device which further includes two coaxial helical springs 29 and 30 serving to urge the roller 26 against the section 23, 24 of the cam face for the purpose of urging the panel 10 toward the closed position, namely in a clockwise direction, as viewed in FIG. 2. That portion of the housing 16 which reciprocably receives the plunger 28 can be said to constitute a cylinder of the aforementioned torque transmitting device, and the axis of the pivot member 27 for the roller 26 is located at one side of the plane which is common to the axes of such cylinder and the shaft 13. In the embodiment of FIGS. 1 to 3, the axis of the pivot member 27 is located slightly below the just mentioned plane, as viewed in FIG. 2.

The means for adjusting the bias of the resilient means including the helical springs 29 and 30 comprises a disc-shaped retainer 31 which is reciprocable in the housing 16 behind the rearmost convolutions of the springs 29, 30 and means for moving the retainer 31 in the housing 16 toward or away from the shaft 13. Such moving means comprises a feed screw 33 which meshes with the central portion of the retainer 31, a stopper or plug 34 which is in mesh with the respective end portion of the housing 16, and a slotted or recessed motion transmitting element 32 which is rotatable in but cannot move axially of the plug 34 and is non-rotatably connected with the adjacent end portion of the feed screw 33. The recess in the exposed end face of the element 32 can receive the working end of a screw driver or the like in order to change the axial position of the retainer 31 and to thereby increase or reduce the bias of the springs 29, 30 upon the plunger 28, i.e., upon the roller 26. In the illustrated embodiment of the improved door check, the biasing means for the plunger 28 comprises a very strong helical spring 29 which operates between the retainer 31 and the rear end face of the plunger 28, and a much weaker helical spring 30 which is surrounded by the spring 29 and operates between the retainer 31 and a washer which is inserted into a counterbore of and bears against an internal shoulder in the plunger 28. Suitable sealing elements are provided to prevent the escape of confined liquid medium from the housing 16 in the region of the plug 34 and motion transmitting element 32.

The pivot member 36 for the roller 35 is mounted at the front end of a support or piston 37 which forms part of a damper. The latter further includes that portion of the housing 16 in which the piston 37 is reciprocable, i.e., such portion of the housing 16 constitutes a cylinder for the piston 37. The chamber of the cylinder for the piston 37 is shown at 38; this chamber is adjacent the left-hand end wall of the housing 16. The chamber 38 is normally sealed from the space which accommodates the central portion of the shaft 13, the cam 22 on the shaft 13 and the torque transmitting device including the plunger 28, roller 26, shaft 27 and helical springs 29, 30. The internal surface of the housing 16 is formed with a circumferentially extending groove 39 which communicates with the chamber 38 and is connected with the space receiving the cam 22 by a channel which is machined into the housing 16 and includes a first radially extending portion 40 in communication with the groove 39, a second radially extending portion 42 in communication with the space around the cam 22 and an axially parallel portion 41 connecting the portions 40, 42 and containing a preferably adjustable flow restrictor 43. The flow restrictor 43 produces the damping action when the shaft 13 is caused to turn clockwise back toward the angular position which is shown in FIGS. 1 and 2 and thereby causes the cam 22 to push the roller 35 and the piston 37 to the left, as viewed in FIG. 2 or 3, so that the liquid medium which fills the chamber 38 is expelled via channel 40–42 back into the space around the cam 22.

The piston 37 resembles a cup having a bottom wall 45. The interior of the piston 37 receives the major portion of an energy storing device 44 in the form of a helical spring which reacts against the left-hand end wall of the housing 16 and bears against the bottom wall 45 to maintain the roller 35 in contact with the respective section 25 of the face on the cam 22. The bottom wall 45 of the piston 37 contains a check valve 46 which opens when the pressure in the space around the cam 22 exceeds the pressure in the chamber 38. The bottom wall 45 is further formed with a substantially centrally located tapped bore 47 for a removable safety relief valve 48 wherein a spring-biased valving element opens when the pressure in the chamber 38 exceeds the pressure in the space around the cam 22.

The bias of the helical spring 44 is a fraction (preferably less than 50 percent) of the combined bias of the springs 29 and 30 which together constitute the means for biasing the roller 26 against the section 23, 24 of the face on the cam 22. All that counts is to ensure that the spring 44 is at least barely able to maintain the roller 35 in contact with the section 25 of the cam 22 when the shaft 13 is rotated in response to movement of the panel 10 from its closed position.

FIGS. 2 and 3 show the shaft 13 in that angular position in which the panel 10 is closed. As soon as a person begins to pivot the panel 10 from the closed position, the arm 14 causes the shaft 13 to turn in a counterclockwise direction as indicated in FIG. 2 by the arrow 49. During the initial stage of such angular movement through a few degrees, the roller 26 is expelled from the concave part 23 of the section 23, 24 of the face on the cam 22 whereby the person pivoting the panel 10 from the closed position encounters a rather substantial resistance to such pivotal movement because the plunger 28 is caused to cover a substantial distance against the opposition of the springs 29, 30 in response to a relatively small angular displacement of the panel 10 and shaft 13. The roller 26 thereupon contacts the gradually sloping portion 24 of the cam face section 23, 24 so that the rate of axial displacement of the plunger 28 in a direction away from the shaft 13 increases more gradually which is felt by the person pivoting the panel 10 toward open position as a relaxation of the resistance. In other words, the panel 10 must be pivoted through a relatively large angle in order to enable the cam 22 to shift the plunger 28 through the same distance as during the initial stage of opening movement when the roller 26 was in contact with the portion 23 of the cam face section 23, 24. Thus, by the simple expedient of altering the configuration (throw) of the cam face section 24, the manufacturer can select the resistance which the panel 10 offers to movement toward the fully open position and also the difference between the resistance to the initial stage and the resistance to the next-following major stage of movement of the panel 10 from the closed to the fully open position. A first important consideration in the selection of the slope of the portion 24 is the comfort to the user of the door and a second important consideration is the reliability of the closing action of the improved door check.

While the roller 26 tracks the portion 24 of the section 23, 24 of the cam face, i.e., while the plunger 28 continues to move toward the retainer 31 against the opposition of the helical springs 29 and 30, the roller 35 tracks the second section 25 of the cam face under the action of the helical spring 44. The roller 35 then rotates in a clockwise direction because the cam 22 turns in the direction which is indicated by the arrow 49. The check valve 46 opens automatically because the volume of the chamber 38 increases and the liquid medium is free to flow through the bottom wall 45 of the piston 37 and into the chamber 38.

When the user of the door has pivoted the panel 10 through an angle which is required or sufficient for convenient passage through the door, the panel 10 is released so that the springs 29 and 30 can take over and push the plunger 28 in a direction toward the shaft 13 to thereby turn the cam 22 in a clockwise direction, as viewed in FIG. 2 and back toward the illustrated angular position. Thus, the panel 10 pivots back toward the closed position. The section 25 of the cam face then moves the roller 35 away from the shaft 13 so that the piston 37 expels liquid medium from the chamber 38 via groove 39 and channel 40–42 whereby the flow restrictor 43 throttles the flow of such liquid medium from the chamber 38 into the space around the cam 22. The relatively weak coil spring 44 is caused to store energy to thus ensure that it can hold the roller 35 in contact with the section 25 of the cam face when the panel 10 is again pivoted from its closed position.

The disc cam 22 can be replaced with a different cam without departing from the spirit of the invention. For example, the cam can have a groove or track for the rollers 26 and 35. Also, the axis of the piston 37 need not coincide with the axis of the plunger 28. The springs 29, 30 can be replaced with or used in addition to a package of dished springs, the housing 16 can be mounted on the frame 11 (in which case each of the two stubs 17 can be connected to a discrete arm 14), the flow restrictor 43 can be installed in the bottom wall 45 of the piston 37, the bias adjusting means can comprise a discrete adjuster for each of the springs 29 and 30, and the cam 22 can be replaced with two cams one of which is tracked by the roller 26 and the other of which is tracked by the roller 35.

An important advantage of the improved door check is that the resistance which the panel 10 (and hence the shaft 13) offers to movement from closed position can be selected practically at will, not only during the initial stage of pivotal movement of the panel 10 from its closed position but also during the major part of the entire angular movement between open and closed positions. Moreover, the manufacturer can select the variations of resistance to movement of the panel 10 to open position during the aforementioned major part of such movement by the simple expedient of adequately selecting the configuration or throw of the portion 24 of that section (23, 24) of the face on the cam 22 which is tracked by the roller 26 while the shaft 13 performs the major part of its angular movement in the counterclockwise direction, as viewed in FIG. 2. Still further, by properly selecting the configuration of the section 25 of the cam face, the manufacturer can regulate the action of the damper which yieldably opposes a movement of the panel 10 back to its closed position.

The cam 22 (or an analogous cam) replaces the customary rack and pinion drive which is used in many conventional door checks and wherein a portion of the rack constitutes a piston which is reciprocable in its cylinder to thereby rotate the pinion or vice versa. A rack and pinion drive does not allow for any changes in the resistance which the panel offers to pivotal movement during different stages of such movement. Thus, were the plunger 28 replaced with a rack meshing with a pinion on the shaft 13, each and every movement of the shaft through a given angle would entail or require a fixed axial displacement of the rack. This would prevent the door check from offering a different resistance to each of a series of different stages of angular movement of the door panel from its closed to its fully open position. The improved door check renders it possible to vary the angle of attack of the roller 26 upon the face of the cam 22 and the extent of axial movement of the plunger 28 in response to angular displacement of the cam 22 so as to obtain a practically infinite number of different characteristic curves for the torque transmitting device even though the helical springs 29, 30 exhibit linear characteristics. The relationship between the angle of attack of the roller 26 and the axial displacement of the plunger 28 is preferably selected in such a way that the door check offers a rather pronounced initial resistance to movement of the panel 10 from its closed position (i.e., the springs 29, 30 exert upon the panel a rather pronounced force during the last stage of movement toward the closed position) and that the resistance of the panel to movement from the closed position decreases abruptly or at least substantially as soon as the panel has completed a relatively small angular movement (e.g., through an angle of approximately two degrees) from its fully closed position. The resistance to further pivoting of the panel 10 to fully open position can remain constant or can even decrease or increase during certain stages of angular movement from 2 degrees to approximately 180 degrees, depending upon the maximum angle through which the panel must or can turn between its closed and fully open positions. All this is accomplished in a simple and effective way, i.e., by the expedient of selecting a cam or a pair of cams whose throw varies in dependency on the desired resistance which the shaft 13 is to offer to rotation during pivoting of the panel between open and closed positions. The damping action can be regulated in an equally simple and effective way by properly selecting the throw of the section 25 of the face on the cam 22.

An advantage of the feature that the torque transmitting device including the parts 26–30 and the damper means including the parts 35–37 are two discrete units, which are movable in the housing 16 independently of one another, is that the damping action need not vary as a function of the torque transmitting action and/or vice versa, i.e., that the roller 35 of the damper can track the section 25 of the cam face independently of the roller 26 which tracks the section 23, 24. Such arrangement further improves the efficiency of the door check and ensures a less pronounced and more uniform wear upon the face of the cam 22.

The feature that the spring 44 is weaker than the springs 29, 30 for the plunger 28 ensures that the roller 35 invariably contacts the section 25 of the face on the cam 22 but does not interfere with or adversely influence the action of the torque transmitting device including the plunger 28 and the springs 29, 30.

The sections 23, 24 and 25 of the face on the cam 22 are asymmetrical to each other with reference to a plane which includes the axis of the shaft 13 and the axis of the follower 28, i.e., the throw of the section 23, 24 is different from that of the section 25. This is the presently preferred configuration of the cam face because it allows for different axial displacements of the plunger 28 and piston 37 in response to a given angular displacement of the cam 22. The lack of symmetry can exist between certain parts of the two sections of the cam or during each and every stage of angular movement of the panel 10 between its closed and fully open positions. The placing of the roller 35 at least slightly off center (i.e., to one side of the plane which includes the axes of the piston 37 and shaft 13) is often desirable and advantageous because this renders it possible to more accurately relate the axial positions of the piston 37 to the angular positions of the cam 22. It was further found that the aforediscussed positioning of the axis of the roller 26 at one side of the plane including the axes of the plunger 28 and shaft 13 facilitates the actuation of the door check. The distance between the axis of the roller 26 and the just mentioned plane can be small or very small.

The provision of the axially adjustable retainer 31 enhances the versatility of the improved door check because it allows for a change in the combined bias of the springs 29 and 30, i.e., for a change in the magnitude of the force with which the springs 29, 30 resist manual pivoting of the panel 10 or with which such springs force the panel to reassume its closed position.

The antifriction bearing 50 enhances the efficiency of the door closer and contributes to a significant reduction of wear upon the cam 22 and the roller 26. In addition, the bearing 50 renders it possible to utilize a smaller resilient element 28–29 which must exert a smaller force.

The antifriction bearing 51 is an optional but desirable and advantageous component of the improved door check. This bearing also contributes to efficiency of the door check and to a reduction of wear upon the roller 35 and cam 22. Still further, the antifriction bearing 51 renders it possible to employ a weaker spring 44 and to reduce the initial stressing of the spring 44.

The door check operates properly when the piston 37 of the damper remains in continuous contact with the section 25 of the cam 22 while the panel 10 is pivoted toward its fully open position. This ensures that the spring 44 can begin to damp the movement of the panel 10 toward its closed position as soon as the panel 10 is released, i.e., as soon as the force tending to move the panel 10 toward open position is weaker than the force which is applied in the opposite direction (by the springs 29 and 30). Such mode of operation reduces the likelihood of the development of shocks or other unpredictable movements of the panel 10 toward its closed position. The reason that the bias of the spring 44 is preferably less than 50 percent of the combined bias of the springs 29 and 30 is that this reduces the likelihood of unpredictable movement of the panel 10 to its closed position during the last stage of such movement, namely, when the bias of the springs 29, 30 is already well below the maximum value whereas the bias of the spring 44 increases toward its maximum value. Were the bias of the spring 44 too pronounced, the spring 44 would cooperate with the hydraulic damper of the door check in such a way that the last stage of movement of the door panel 10 to its closed position would be too slow.

The springs 29 and 30 act as a unit. These springs can be replaced with a single helical spring, with a package of dished springs or with any other single or composite resilient element which is capable of biasing the roller 26 against the cam 22 with a force that is necessary to ensure a predictable closing of the door panel 10 within a desired interval of time against the opposition of the hydraulic damper and of the springs 44 or an equivalent resilient element.

A further important advantage of the improved door check is that the housing 16 constitutes a cylinder for the plunger 30 which carries the roller 26 as well as for the piston 37 which carries the roller 35. Each of the parts 30 and 37 performs a simple linear reciprocatory movement. The parts 30 and 37 are disposed at opposite sides of the shaft 13 and cam 22.

As already mentioned above, the utilization of a shaft 13 which is sufficiently long to have its end portions 17 project from two opposite sides of the housing 16 renders it possible to use the improved door check on left-hand or right-hand doors.

The utilization of a heart cam 22 or an analogous cam with asymmetrical sections (23–24 and 25) is desirable and advantageous because this ensures that the door check can close a door panel which has been opened through full 180 degrees. Moreover, the hydraulic damping action is highly satisfactory during each stage of movement of the door panel 10 or at least during a wide range of such movements. The improved door check can be used with advantage on doors whose panels are pivotable through 180 degrees and which are capable of closing automatically from fully open or from any partly open position of the panel.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. In a door check, a housing; a shaft rotatably journalled in said housing; cam means provided on said shaft in said housing and having first and second sections; means for transmitting torque to the first section of said cam means so as to urge said cam means to rotate in a predetermined direction, including a first support movable in said housing at one side of said shaft, a first follower provided on said support and tracking the first section of said cam means, and first resilient means for biasing said support toward said cam means with a first force; and damper means arranged to yieldably oppose rotation of said shaft in said direction, including a second support movable in said housing at the other side of said shaft, a second follower provided on said second support and tracking the second section of said cam means, and second resilient means for biasing said second follower against the second section of said cam means with a second force which at most equals 50 percent of said first force.

2. The structure of claim 1, wherein said first support comprises a pivot member for said first follower and an antifriction bearing interposed between said pivot member and said first follower.

3. The structure of claim 2, wherein said bearing comprises a needle bearing.

4. The structure of claim 1, wherein said second support comprises a pivot member for said second follower and a bearing interposed between said pivot member and said second follower.

5. The structure of claim 4, wherein said bearing comprises an antifriction bearing.

6. The structure of claim 5, wherein said antifriction bearing comprises a needle bearing.

7. The structure of claim 1, wherein at least one of said resilient means comprises at least one helical spring.

8. The structure of claim 1, wherein said first resilient means comprises at least one helical spring.

9. The structure of claim 1, wherein said housing comprises a cylinder and said first support is reciprocable in said cylinder substantially at right angles to the axis of said shaft.

10. The structure of claim 1, wherein said housing comprises a cylinder and said second support is reciprocable in said cylinder substantially at right angles to the axis of said shaft.

11. The structure of claim 1, wherein said housing comprises coaxial first and second cylinders for said first and second supports, respectively, said supports being reciprocable in the corresponding cylinders substantially at right angles to the axis of said shaft.

12. The structure of claim 1, wherein each of said supports comprises a pivot member for the respective follower and further comprising at least one antifriction bearing between at least one of said pivot members and the respective follower.

13. The structure of claim 1, wherein said housing is elongated and said shaft extends transversely of and is remote from the ends of said housing, and further comprising means for securing said housing to a door panel and means for coupling said shaft to the frame for the panel.

14. The structure of claim 1, further comprising means for adjusting the bias of at least one of said resilient means.

15. The structure of claim 1, wherein said followers are rotatable about axes which are at least substantially parallel to the axis of said shaft.

16. The structure of claim 1, wherein said shaft has end portions at least one of which is disposed outside of said housing.

17. The structure of claim 16, wherein said one end portion has a non-circular outline.

18. The structure of claim 1, wherein said cam means includes a heart cam.

19. The structure of claim 1, wherein the first section of said cam means is asymmetrical to said second section.

* * * * *